United States Patent [19]

Ueda et al.

[11] 4,259,177

[45] Mar. 31, 1981

[54] PROCESS FOR THE PRODUCTION OF OLEFINS

[75] Inventors: Tetsuo Ueda; Masuo Ohta, both of Yokohama; Seiroku Sugano, Fuchu, all of Japan

[73] Assignee: Director-General of the Agency of Industrial Science and Technology, Tokyo, Japan

[21] Appl. No.: 103,174

[22] Filed: Dec. 13, 1979

[30] Foreign Application Priority Data

Dec. 21, 1978 [JP] Japan ..... 53/156893

[51] Int. Cl.[3] ..... C10G 9/32; C07C 4/04

[52] U.S. Cl. ..... 208/127; 585/648; 585/650

[58] Field of Search ..... 208/127; 585/648, 650

[56] References Cited

U.S. PATENT DOCUMENTS 2,889,267 6/1959 Barr et al. ..... 208/127

3,261,775 7/1966 Blaser ..... 208/127

4,097,362 6/1978 McKinney et al. ..... 208/127

*Primary Examiner*—T. M. Tufariello

*Attorney, Agent, or Firm*—Frishauf, Holtz, Goodman & Woodward

[57] ABSTRACT

A process for producing olefines by using a fluidized bed of coke particles provided in each of a reactor and a heater, circulating coke particles through the reactor and the heater, heating the coke particles by a combustion of fuel and if desired, a part of the coke particles in the heater, thermally cracking a heavy oil with a heated coke particles as a heat carrier in the reactor, the improvement which comprises a distillation residue is converted into a high-temperature, low-calorie gas in a combustion chamber, and the coke particles is heated with the gas in the heater, further an increment of coke deposited on a surface of the coke particles is burned by blowing air to the heater.

5 Claims, 1 Drawing Figure

PROCESS FOR THE PRODUCTION OF OLEFINS

BACKGROUND OF THE INVENTION

This invention relates to a process for the production of olefines such as ethylene, propylene and the like by circulating coke particles through both fluidized beds in a reactor and a heater, heating the coke particles by combustion of fuel and, if desired, a part of the coke particles in the heater and on the other hand, thermally cracking a heavy oil such as crude oil, its distillation residue, etc. with the heated coke particles as a heat carrier in the reactor (hereinafter referred to as "coke fluidized bed cracking method"), whereby a distillation residue obtained by the distillation of a liquid by-product in thermal cracking (hereinafter referred to as "by-product residue") can be used as a heat source for heating the coke particles and at the same time said by-product residue is converted into a low-calorie gas which has wide application and can be easily handled.

When olefines such as ethylene, propylene and the like are produced by thermal cracking of a petroleum fraction, light fractions having a high content of paraffinic hydrocarbon are suitable as feed stock, but such light fractions can be produced only in a low yield from a crude oil and are expensive. Therefore, it is very important that a heavy oil such as crude oil, its distillation residue and the like, which is relatively cheap and is readily available in secure, steady supply, is used as a starting material for producing olefines.

On thermal cracking of a heavy oil such as crude oil or its distillation residue, etc., under such a condition that ethylene can be produced in a high yield, a large amount of the liquid product is formed as shown in Table 1.

TABLE 1

| Product pattern obtained by thermal cracking of heavy oil (wt %) | | | |
|---|---|---|---|
| Feed stock / Product | Middle East crude oil | Atmospheric residue of Middle East crude oil | Vacuum residue of Middle East crude oil |
| Cracked gas | 55 | 48 | 39 |
| Liquid product | | | |
| By-product light oil | 13 | 15 | 9 |
| Middle fraction oil | 13 | 10 | 6 |
| By-product residue* | 16 | 23 | 37 |
| Coke | 3 | 4 | 9 |

*When middle fraction is not separated, the by-productresidue is composed of middle fraction oil and the by-product residue described in Table 1.

The liquid product can be separated by distillation into a by-product light oil (distilled oil) and the residue and, if desired, into three fractions consisting of by-product light oil, middle fraction oil and the residue.

By-product light oil is hydrocarbon oil containing a large amount of benzene, toluene, xylene and the like and useful as a raw material of benzene, toluene, xylene and the like. The residue, i.e. by-product residue, has generally a high content of sulfur and is a pitchy substance having a high softening point and thus its use is restricted.

Recently, it was proposed that the by-product residue can be used as a binder for blast furnace coke, but it has not come into wide use. Moreover, since the by-product residue has no solubility with the petroleum fraction of straight-run and has a high content of sulfur, its use as fuel in conventional boilers, etc., is difficult and it is necessary to develop special boilers in which the by-product residue is exclusively burned.

In general, when a heavy oil is thermally cracked, a large amount of coke is produced, adhered to the wall surface of the tube and prevents the heat transfer. Therefore, a heavy oil cracking operation can not be continued in a tubular thermal cracking furnace used for the thermal cracking of the light fraction. On the contrary, operational difficulties rarely occur and long run operation is possible in a fluidized bed cracker, because the resulting coke is deposited mainly on the surface of the particles forming the fluidized bed.

Coke fluidized bed cracking method is suitable especially for the thermal cracking of a heavy oil, since this method employs a fluidized bed system. That is, the operational difficulties caused by the deposition of the coke rarely occur and the by-product residue can be used as a heatsource for the thermal cracking.

In the coke fluidized bed cracking method, the heating of the coke particles in the heater is effected by combustion of the increment of the coke particles in combination with a heat exchange with the high-temperature, low-calorie gas fed from a combustion chamber arranged at the side of the heater. The main purpose of the former is to keep constant the amount of coke in the equipment by combustion of the increment of coke deposited on the surface of the coke particles by thermal cracking of feed stock, and thus only a small amount of heat is generated by such combustion. Namely, since the amount of coke deposited is small as shown in Table 1, the amount of heat generated by its combustion forms only a part of a required amount of heat (calorific value equivalent to about 20 wt % of the feed stock). Therefore, the major portion of the required amount of heat must be supplied by the high-temperature combustion gas from the combustion chamber.

Hitherto, as a heating method of the coke particles in the above case, it is known that the coke particles are heat exchanged with the high-temperature combustion gas generated by perfect combustion of fuel oil or fuel gas with air. On the other hand, the increment of the coke particles is burned with oxygen remaining in the combustion gas. However, this method has the following disadvantages:

(1) In order to control the amount for combustion of coke deposited on the surface of the coke particles, the proportion of oxygen remaining in the combustion gas fed from the combustion chamber must be controlled and therefore the combustion condition of coke can not be controlled irrespective of combustion condition in the combustion chamber.

(2) Since the percentage of excessive air in the combustion chamber is determined depending on the amount for combustion of coke as described above, its amount is generally about 0–50%, and the temperature in the combustion chamber becomes very high. Therefore, an expensive special material is required for fire brick of the combustion chamber.

(3) Concentration of nitrogen oxide in the combustion gas becomes higher, since the combustion chamber is maintained at a high temperature and under an oxidizing atmosphere.

SUMMARY OF THE INVENTION

An object of this invention is to provide a process for heating the coke particles, whereby the above disadvantages have been eliminated. In this invention, a large amount of by-product residue can be converted into a high-temperature, low-calorie gas having wide use by partial combustion of residue under a condition of excess of fuel relative to air in a combustion chamber, and the coke particles can be heated with said high-temperature, low-calorie gas.

DETAILED DESCRIPTION OF THE INVENTION

Figure 1:
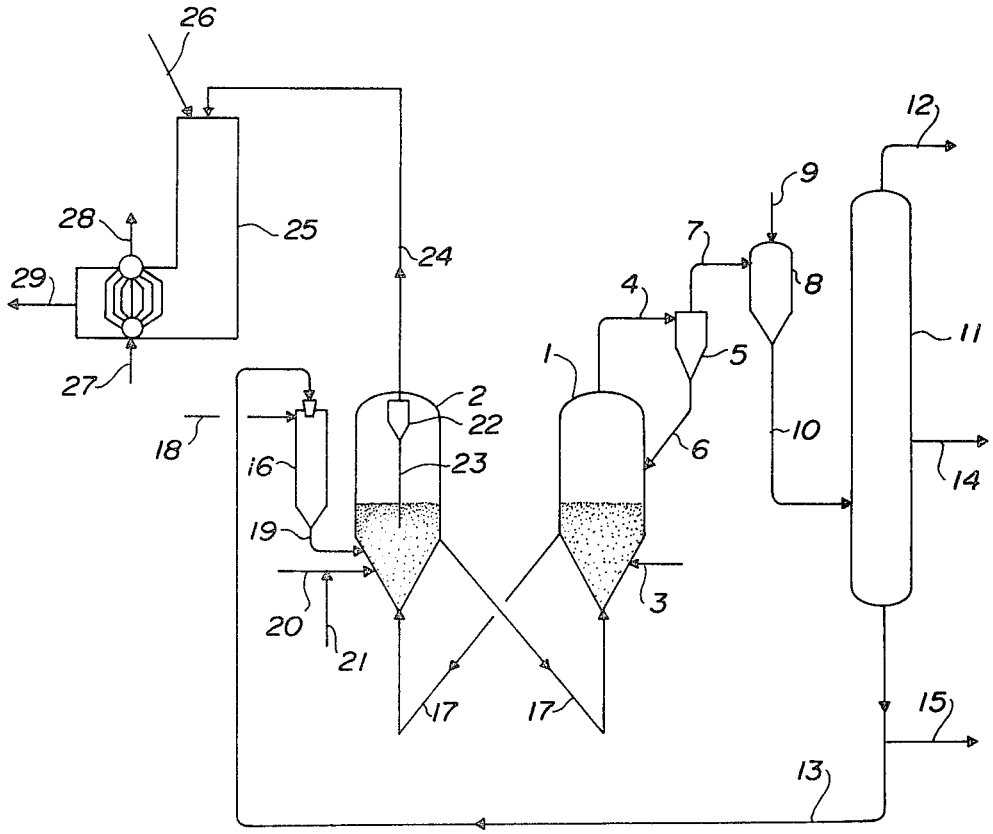
FIG. 1 shows a flowsheet of an embodiment of the process of this invention.

Since the by-product residue supplied into the combustion chamber is subjected to partial combustion, the amount of heat generated by the combustion of the by-product residue can be balanced, with the heat required in the reactor and the heater, even if the by-product residue to be processed is in a far larger amount than the fuel required in case of the perfect combustion, and if desired, all by-product residue can be converted into the low-calorie gas.

According to this invention, air for the combustion of coke is blown directly into the heater so as to control the combustion condition in the combustion chamber irrespective of the condition of the combustion of coke in the heater. In order to avoid the combustion of the low-calorie gas introduced from the combustion chamber by air in the heater, the inlet of air is necessarily attached below the inlet of the low-calorie gas to the heater, preferably 0.3 meter or more below. In this case, a plurality of the inlets of air may be attached according to the amount of the combustion of coke. If the blowing velocity of air at the inlet is too low, the coke particles may flow back into the air pipe which may be finally blocked, whereas the coke particles may be finely divided by an air jet, if the blowing velocity of air is too high. Accordingly, it is desired that air is blown in such a velocity that a pressure drop at the inlet ranges from 0.2 to 4 kg/cm$^2$. In order to avoid the rapid combustion of coke near to the air inlet, the partial pressure of oxygen can be adjusted by mixing optionally nitrogen gas, steam and the like together with air.

The combustion condition of the combustion chamber should be determined in consideration of the required amount of heat for the thermal cracking of feed stock, the amount of the by-product residue to be converted into the low-calorie gas, the calorific value of the generated gas and the like.

When excess of fuel in the partial combustion, namely percentage of an excessive amount of supplied fuel relative to an amount of fuel which is stoichiometrically required for the perfect combustion with an amount of supplied air, is too small, the calorific value of the generated gas is lowered. On the contrary, when excess of fuel is too large, soot is produced in a large amount and the state of the combustion becomes unstable. Therefore, excess of fuel ranging from about 20% to 100% is preferred.

Yields of the by-product residue vary depending on the kind of feed stock. Since the by-product residue has restricted use, in general, it is desirable that almost all of it can be converted into the low-calorie gas. In this case, excess of fuel is dependent on a yield of the by-product residue based on feed stock.

In the most of feed stock processed with the coke fluidized bed cracking method, yields of the by-product residue range from 30 to 40 wt %. Even if the almost all amount of the by-product residue is converted into the low-calorie gas, excess of fuel falls within the range of 20–100% as described above.

The gas generated by partial combustion of the by-product residue is a high-temperature, low-calorie gas containing combustible components such as $H_2$, CO, $CH_4$ and the like. Table 2 shows the relationship of excess of fuel with the composition of the low-calorie gas which is formed by partial combustion of the by-product residue obtained by thermal cracking of vacuum residue of Middle East crude oil.

TABLE 2

Composition of the low-calorie gas generated by partial combustion of the by-product residue of the thermal cracking (dry gas)

| Excess of fuel (%) | 10 | 20 | 35 | 65 | 100 |
|---|---|---|---|---|---|
| Composition of the gas (vol. %) | | | | | |
| $H_2$ | 0.7 | 1.2 | 1.6 | 2.5 | 3.3 |
| CO | 4.1 | 5.8 | 7.4 | 8.8 | 9.7 |
| $CO_2$ | 15.4 | 14.4 | 13.2 | 11.9 | 10.9 |
| $N_2$ | 79.2 | 78.0 | 77.1 | 76.1 | 75.3 |
| Sulfur compound | 0.6 | 0.6 | 0.7 | 0.7 | 0.8 |
| Calorific value (Kcal/Nm$^3$) | 175 | 239 | 303 | 366 | 402 |

For the sufficient conversion of the by-product residue into gas by partial combustion it is desirable to atomize the by-product residue sufficiently by blowing steam in an amount of 5–35 wt % into the by-product residue supplied into the combustion chamber.

Embodiments of this invention will be now illustrated in reference to FIG. 1, in order that this invention may be more fully understood. FIG. 1 shows one embodiment of this invention. In FIG. 1, 1 is a reactor having a fluidized bed of coke particles and 2 is a heater having a fluidized bed of coke particles. Feed stock is supplied through a pipe 3 into the reactor 1 where it is thermally cracked at a temperature of 700°–850° C. The cracked product is introduced through a pipe 4 into a cyclone 5 where the coke particles accompanied by it is separated off. The separated coke particles are circulated to the reactor 1 through pipe 6.

The cracked product is fed through a pipe 7 into a quenching vessel 8, quenched to 600° C. or below, preferrably 200°–400° C. with quenching oil supplied from a pipe 9, and then introduced through a pipe 10 into a distillation tower 11 to separate a cracked gas and a liquid product. The cracked gas and by-product light oil are transported to the next step through a pipe 12 at the top of the distillation tower. On the other hand, the by-product residue is drawn from the bottom of the tower through a pipe 13 and supplied as fuel into a combustion chamber 16 arranged at the side of the heater 2. When the separation of middle fraction oil from the by-product residue is carried out in the distillation tower, middle fraction oil is fed through a pipe 14 to the next step, and only the more concentrated by-product residue is introduced through a pipe 13 into the combustion chamber 16. A part of the by-product residue can be reused as quenching oil by branching it through a pipe 15. If necessary, this branched residue can be further branched out for the other use.

The by-product residue supplied into the combustion chamber is subjected to combustion with air fed through a pipe 18. Since the by-product residue as fuel is, however, burned in a large excess (as compared with combustion with a stoichiometric amount of air), only a part of the by-product residue is burned (partial combustion) and the remaining by-product residue is gasified to generate a low-calorie gas having high temperatures of 1400°-1800° C. The obtained low-calorie gas is blown through a pipe 19 into the heater 2, in which it heats the coke particles forming the fluidized bed.

On the other hand, coke deposited on the surface of the coke particles by thermal cracking of the feed stock is also subjected to combustion in the fluidized bed of the heater 2 and used as a heat source for heating of the coke particles. In order to control the combustion condition of coke deposited irrespective of combustion condition of the by-product residue, air for the combustion of the surface deposited coke is blown through a pipe 20 directly into the heater. The inlet of air is attached below the inlet of the low-calorie gas to the heater, namely below the part of connecting the pipe 19 with the heater so as to avoid the combustion of the low-calorie gas blown from the combustion chamber by air in the heater. In order to avoid the rapid combustion of coke near to the inlet of air attached to the heater, the partial pressure of oxygen in air can be adjusted by feeding steam, $N_2$ and the like through a pipe 21 to mix with air.

The coke particles are heated at 720°-900° C. as described above and then circulated to the heater through a pipe 17 to supply an amount of heat required for the thermal cracking of the feed stock. The low-calorie gas, the temperature of which is lowered by heat exchange with the coke particles, is separated from the accompanying coke particles in the cyclone 22 and then removed from of the heater through a pipe 24. The coke particles separated are returned to the fluidized bed of the heater through a pipe 23.

The low-calorie gas obtained from the heater can be used in general as fuel gas for a furnace and the like after removing dust and $SO_x$. Alternatively, as shown in FIG. 1, the low-calorie gas can be fed into a combustion boiler 25 and subjected to recombustion by supplying air through a pipe 26 to evolve a flue gas having a temperature of 1000° C. or above, and by the sensible heat of this flue gas a large amount of steam 28 having high pressure of 30-60 $Kg/cm^2G$ or above is generated from a boiler water fed through a pipe 27. The flue gas, temperature of which is lowered by the generation of steam with loss of sensible heat, is then transported to a step for the processing of the flue gas through a pipe 29.

The following is a summary of the effects accomplished by this invention:

(1) Since condition of the combustion of the coke particles in the fluidized bed of the heater can be controlled quite irrespective of those of the by-product residue in the combustion chamber, heating condition can be optionally selected within a wide range corresponding to the variation of the condition of the thermal cracking in the reactor and to the variation of the kind of the feed stock. Therefore, operation of the equipment is greatly improved.

(2) The by-product residue, which is obtained in a large amount in the production of olefines such as ethylene, propylene and the like by a thermal cracking of heavy oil such as crude oil, its distillation residue and the like, can be completely gasified and a special boiler for exclusive combustion of by-product residue or a desulfurizing device for middle fraction oil and the like is not required for the processing of the by-product residue.

(3) High-pressure steam can be generated by the combustion of the low-calorie gas obtained from the by-product residue in a recombustion boiler as shown in FIG. 1. In an equipment for producing ethylene by coke fluidized bed cracking method, the power requirement of the equipment can be self-sufficient, when the high-pressure steam recovered and is used for a steam turbine as the power source for the equipment. Furthermore, since the self-sufficiency of steam can be also attained by the use of steam extracted from the turbine for other applications, operating cost is considerably decreased as compared with use of conventional equipment.

(4) Since the by-product residue is subjected to partial combustion in the combustion chamber arranged at the side of the heater, the combustion temperature can be lowered as compared with the case of the perfect combustion, and expensive special material is unnecessary for a fire brick of the combustion chamber and also a large amount of cooling steam is not necessarily used for the lowering of the combustion temperature.

(5) Since the inside of the combustion chamber is maintained at a low temperature and under a reducing atmosphere, the amount of nitrogen oxide generated is substantially decreased.

(6) The low-calorie gas having left the heater contains still a small amount of coke particles after it had been passed through the cyclone. When a recombustion boiler is provided at the outlet of the heater as shown in FIG. 1, the temperature of the flue gas in the heater must raise to about 1200° C. for the combustion of those coke particles in the said recombustion boiler. Therefore, in the conventional methods a large amount of supplementary fuel gas must be supplied into the recombustion boiler, whereas in the process of this invention the required amount of supplementary fuel gas is substantially decreased, since the calorific value of the low-calorie gas leaving the heater is relatively high.

This invention will be further illustrated by the following examples.

EXAMPLE 1

Middle East heavy crude oil was thermally cracked at a temperature of 750° C. in a ratio by weight of a diluting steam to the feed stock of 1.0 in the reactor as shown in FIG. 1 to give 49 wt % of a cracked gas, 11 wt % of a by-product light oil, 32 wt % of a by-product residue and 8 wt % of a coke. All of the resulting by-product residue was fed into the combustion chamber arranged at the side of the heater and atomizing steam was blown in as an amount of 20 wt % based on the by-product residue. The by-product residue was subjected to partial combustion in excess of fuel of 33% to give 7.6 $Nm^3$ of a low-calorie gas per Kg of the feed stock. The composition of the resulting gas is as follows:

| | | | |
|---|---|---|---|
| $H_2$ | 1.9 vol % | $H_2O$ | 13.3 vol % |
| CO | 6.9 vol % | $N_2$ | 66.7 vol % |
| $CO_2$ | 10.7 vol % | Sulfur compound | 0.5 vol % |

The combustion chamber was at a temperature of 1700° C. and did not need to use any special material as its furnace material. Air was blown directly into the heater so as to burn 60% of the deposited coke. As a result, the condition of the combustion of the coke could be controlled completely irrespective of the combustion condition in the combustion chamber and therefore an amount of the coke to be burned was easily adjustable.

Since the inlet of air for the combustion of the coke was attached 1.5 meters below the inlet of the low-calorie gas described above, almost all oxygen contained in the blown air was effectively used for the combustion of the coke and the low-calorie gas was not subjected to combustion at all. One inlet of air was attached and the pressure drop at the inlet was 1.0 kg/cm$^2$. The back flow of the coke particles from the inlet and the attrition of the coke particles near to the inlet was not practically found. The remaining coke (40%) produced by thermal cracking was consumed for the attrition, the reaction with steam, etc.

The flue gas from the heater containing the low-calorie gas described above was subjected to recombustion at 1200° C. together with 0.06 Kg of supplementary fuel gas per Kg of the feed stock in the recombustion boiler and the steam was generated with a sensible heat of the flue gas, so that a high-pressure steam having a pressure of 80 Kg/cm$^2$G could be obtained in an amount of 3.3 Kg per Kg of the feed stock.

The following Table 3 shows the comparison of the results according to this invention with those according to the process, in which the perfect combustion was carried out in the combustion chamber arranged at the side of the heater.

TABLE 3

| | Partial combustion (this invention) | Perfect combustion |
|---|---|---|
| By-product residue of thermal cracking | 0.32 kg/kg . feed stock | 0.32 kg/kg . feed stock |
| By-product residue fed into the combustion chamber | 0.32 kg/kg . feed stock | 0.24 kg/kg . feed stock |
| Surplus by-product residue | 0 kg/kg . feed stock | 0.08 kg/kg . feed stock |
| Excess of fuel in the combustion chamber | 33 percent | 0 percent |
| Temperature in the combustion chamber | 1700° C. | 1910° C. |
| Nitrogen oxides generated in the combustion chamber | about 100 ppm | 500–600 ppm |
| Composition of gas at the outlet of the combustion chamber | | |
| $H_2$ | 1.9 vol. % | <0.01 vol. % |
| CO | 6.9 vol. % | 0.2 vol. % |
| $CO_2$ | 10.7 vol. % | 15.4 vol. % |
| $H_2O$ | 13.3 vol. % | 13.0 vol. % |
| $N_2$ | 66.7 vol. % | 71.0 vol. % |
| $O_2$ | 0 vol. % | 0.1 vol. % |
| Sulfur compound | 0.5 vol. % | 0.3 vol. % |

EXAMPLE 2

Vacuum residue of Middle East crude oil was thermally cracked by the use of a similar equipment and the similar operation conditions as described in Example 1 to give 39% by weight of a cracked gas, 9 wt % of a by-product light oil, 43 wt % of a by-product residue and 9 wt % of a coke.

Similarly to Example 1, the results according to this invention were compared with those according to the process, in which the perfect combustion was carried out in the combustion chamber. Both of them were summarized in the following Table 4.

TABLE 4

| | Partial combustion (this invention) | Perfect combustion |
|---|---|---|
| By-product residue of thermal cracking | 0.43 kg/kg . feed stock | 0.43 kg/kg . feed stock |
| By-product residue fed into the combustion chamber | 0.38 kg/kg . feed stock | 0.23 kg/kg . feed stock |
| Surplus by-product residue | 0.05 kg/kg . feed stock | 0.20 kg/kg . feed stock |
| Excess of fuel in the combustion chamber | 65 percent | 0 percent |
| Temperature in the combustion chamber | 1670° C. | 1920° C. |
| Nitrogen oxides generated in the combustion chamber | about 60 ppm | 500–600 ppm |
| Composition of gas at the outlet of the combustion chamber | | |
| $H_2$ | 2.1 vol. % | <0.01 vol. % |
| CO | 7.7 vol. % | 0.2 vol. % |
| $CO_2$ | 10.4 vol. % | 15.8 vol. % |
| $H_2O$ | 12.8 vol. % | 12.1 vol. % |
| $N_2$ | 66.4 vol. % | 71.4 vol. % |
| $O_2$ | 0 vol. % | 0.1 vol. % |
| Sulfur compound | 0.6 vol. % | 0.4 vol. % |

EXAMPLE 3

Atmospheric residue of Middle East crude oil was thermally cracked by the use of a similar equipment and the similar operation conditions as described in Example 1 to give 48 wt % of a cracked gas, 15 wt % of a by-product light oil, 33 wt % of a by-product residue and 4 wt % of a coke.

Similarly to Example 1, the results according to this invention were compared with those according to the process, in which the perfect combustion was carried out in the combustion chamber. Both of them were summarized in the following Table 5.

TABLE 5

| | Partial combustion (this invention) | Perfect combustion |
|---|---|---|
| By-product residue of thermal cracking | 0.33 kg/kg . feed stock | 0.33 kg/kg . feed stock |
| By-product residue fed into the combustion chamber | 0.33 kg/kg . feed stock | 0.26 kg/kg . feed stock |
| Surplus by-product residue | 0 kg/kg . feed stock | 0.07 kg/kg . feed stock |
| Excess of fuel in the combustion chamber | 38 percent | 0 percent |
| Temperature in the combustion chamber | 1800° C. | 1980° C. |
| Nitrogen oxides generated in the combustion chamber | about 100 ppm | 500-600 ppm |
| Composition of gas at the outlet of the combustion chamber | | |
| $H_2$ | 0.7 vol. % | <0.01 vol. % |
| CO | 3.7 vol. % | 0.2 vol. % |
| $CO_2$ | 13.2 vol. % | 15.5 vol. % |
| $H_2O$ | 12.9 vol. % | 12.9 vol. % |
| $N_2$ | 69.2 vol. % | 71.0 vol. % |
| $O_2$ | 0 vol. % | 0.1 vol. % |
| Sulfur compound | 0.3 vol. % | 0.3 vol. % |

What is claimed is:

1. In the process for producing olefines by using a fluidized bed of coke particles provided in each of a reactor and a heater, circulating coke particles through the reactor and the heater, heating the coke particles by a combustion of fuel and a part of the coke particles in the heater, and thermally cracking a heavy oil with a fluidized bed of said heated coke particles as a heat carrier in the reactor, the improvement which comprises introducing a distillation residue obtained by distillation of the liquid by-product of thermal cracking into a combustion chamber and subjecting said residue to partial combustion with air in an excess of said residue, said excess of residue being from 20 to 100 percent of the stoichiometric amount, to generate a high-temperature, low-calorie gas, introducing said gas through a side inlet into the heater in order to heat the coke particles by heat exchange, blowing air from an air inlet positioned below said inlet for introducing the high-temperature, low-calorie gas into said heater and combusting coke deposited on the surface of said coke particles by thermal cracking of the heavy oil in the reactor in order to heat said coke particles.

2. The process according to claim 1, wherein the blowing of said air is performed at a rate of a pressure drop at the inlet ranging from 0.2 to 4 kg/cm$^2$.

3. The process according to claim 1 or 2, wherein steam in an amount of from 5 to 35 weight percent is blown into the by-product residue supplied into the combustion chamber in order to atomize by-product residue.

4. The process according to claim 3, wherein the thermal cracking of the heavy oil is performed at a temperature of from 700° to 850° C.

5. The process according to claim 1 or 2, wherein the thermal cracking of the heavy oil is performed at a temperature of from 700° to 850° C.

* * * * *